United States Patent [19]

Fogh et al.

[11] 4,147,121

[45] Apr. 3, 1979

[54] SELF-RELEASING TRAVELER AND CAM CLEAT

[76] Inventors: Hans M. Fogh, 3392 Credit Heights Dr.; Evert J. Bastet, Apt. 708, 3045 Queen Frederica Dr., both of Mississauga, Canada

[21] Appl. No.: 848,123

[22] Filed: Nov. 3, 1977

Related U.S. Application Data

[63] Continuation-in-part of Ser. No. 704,834, Jul. 13, 1976, abandoned.

[51] Int. Cl.[2] ..... B63B 21/24

[52] U.S. Cl. ..... 114/204; 114/199; 24/132 AA

[58] Field of Search ..... 114/204, 218, 221 R, 114/112, 108, 109, 111, 39, 199; 24/115 R, 115 B, 115 C, 115 F, 115 J, 130, 132 R, 132 AA, 132 AC, 134 R, 134 KB, 134 L, 134 M, 134 P, 136 R

[56] References Cited

U.S. PATENT DOCUMENTS

| | | | |
|---|---|---|---|
| 2,627,834 | 2/1953 | Roberts et al. | 114/199 |
| 3,186,372 | 6/1965 | Cleveland | 114/199 |
| 3,765,061 | 10/1973 | Nash | 114/218 |

*Primary Examiner*—Trygve M. Blix
*Assistant Examiner*—Jesus D. Sotelo

[57] ABSTRACT

A traveler for a sailboat having a track way and a traveler car moving to and fro along the track way and attachments on the traveler for attaching control ropes on either side thereof for controlling the position thereof from either side of the sailboat, and cleats on either side of the traveler for fastening the control ropes on either side thereof, and cleat releasers on the traveler car, being movable relative to the cleats, and being operable in response to movement of the traveler car to release the cleats on one side of the traveler, while leaving the cleats on the other side of the traveler undisturbed. Also disclosed is a cam cleat having a cam cleat releaser movable relative thereto for opening of the cam cleat from a remote location.

19 Claims, 7 Drawing Figures

FIG 3
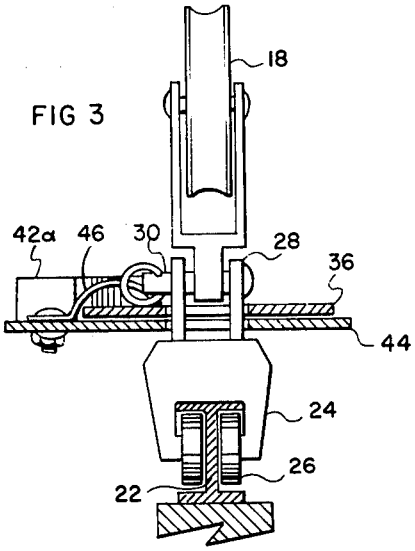
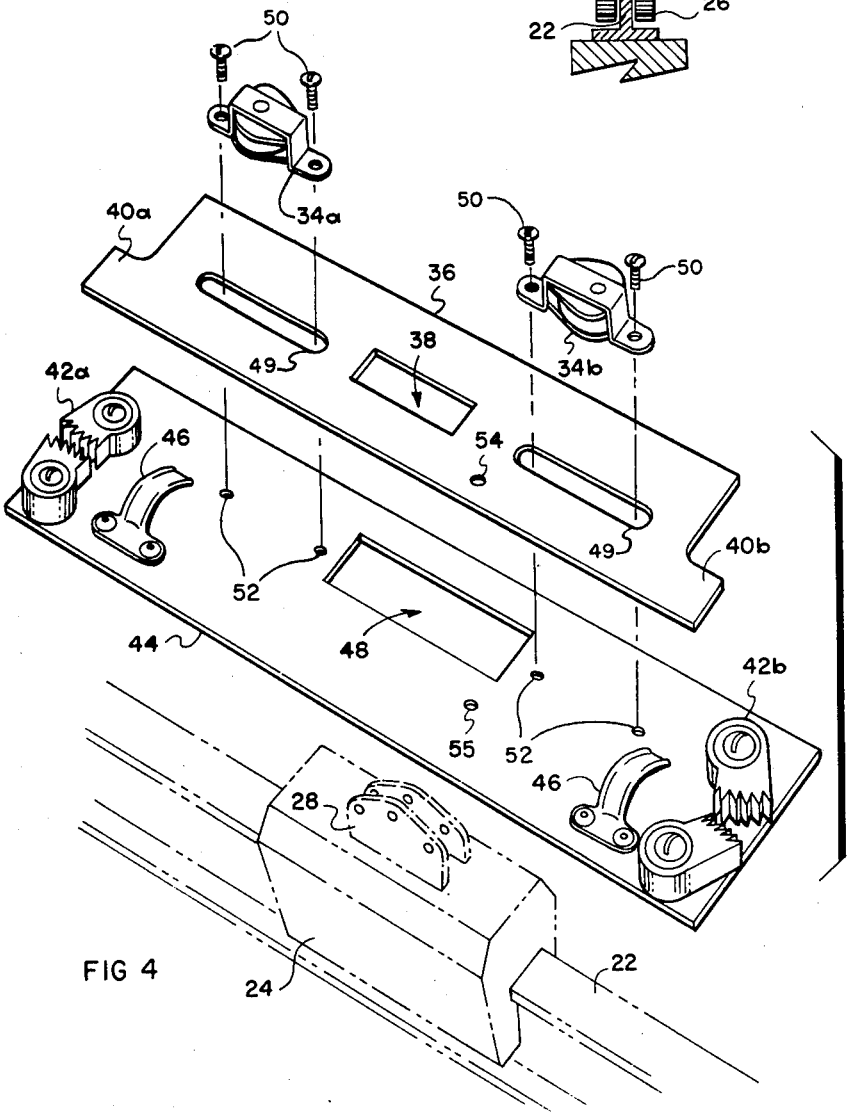
FIG 4

SELF-RELEASING TRAVELER AND CAM CLEAT

This application is a continuation in part of Ser. No. 704,834 filed July 13, 1976 entitled "Self-releasing Traveler and Cam Cleat" since abandoned.

The invention relates to a traveler for a sailboat of the type employing a track way, and a traveler car moving to and fro along the track way, and also relates to a self-releasing cam cleat for securing the releasing rope on a sailboat.

BACKGROUND OF THE INVENTION

The various ropes (known as sheets) on a sailboat that are used for controlling the sails, and sailboat rig, are usually led around pulleys or sheaves, and secured typically in cam cleats which provide a quick means of manually securing or releasing the ropes.

In many sailboats the helmsman and crew are forced to sit on one side of the boat in order to counterbalance the forces of the wind on the sails, and accordingly, while sailing on one or other tack, it is impossible for the crew to move inboard, even as far as the center line of the boat. It is therefore the practice in many cases to provide for the accessibility of such control ropes or sheets on both sides of the boat so that all of the various controls may be operated on either tack without the crew having to move inboard.

Much ingenuity and experimentation has been expended in developing a variety of different control ropes and sheets, accessible from either side of the boat. The principle sheet or control rope on such a sailboat is usually the main sail sheet, i.e., the rope connecting the boom with the sailboat, by means of which the boom may be let out or pulled in. In the past, the main sheet was in many cases simply led through a pulley anchored along the center line of the sailboat, usually on the transom. However, in many more modern designs, it is desirable that the main sheet pulley shall be movable from side to side of the boat away from the center line. For this purpose, the main sheet pulley is mounted on a traveler consisting of a track way mounted transversely across the boat, and a traveler car which is slidable along the track way from side to side. The main sheet pulley is mounted on the traveler car.

In order to move the traveler car and position it in the right place for any particular wind or sailing condition, control ropes are provided which are operable from each side of the boat. Such control ropes are in the majority of cases fastened in cam cleats, of a conventional design, so that once the traveler is set in a desired position it will be held there.

This type of arrangement has always been subject to the serious disadvantage that when sitting for example on the starboard side of the boat the helmsman cannot reach the control rope on the port side of the boat and vice-versa. If for example the port side traveler control rope is cleated, and the helmsman is sitting on the starboard side of the boat, for example having just tacked from port to starboard tack, then it may be impossible for him to adjust the traveler position from the starboard side. It is then necessary to momentarily lean into the boat, release the port side traveler control rope, and then move back to the starboard side of the boat and operate the starboard side traveler. All of this must be done while still holding the main sheet rope itself, and controlling the tiller.

It is therefore clearly desirable that a traveler may be provided with some form of cleat releasing means by means of which a rope cleated on one side of the boat may be released from the other side of the boat.

BRIEF SUMMARY OF THE INVENTION

The invention seeks to overcome the foregoing disadvantages by the provision of a traveler having a track way, and a traveler car moving to and fro along the track way, and attachment means on the traveler car for attaching control ropes on either side thereof for controlling the position thereof from either side, and cleat means on either side of the traveler car for fastening the control ropes on either side thereof, and finger means on the traveler car, being movable relative to said cleat means, and being operable in response to wind pressure on e.g., the main sail to release the cleat means on one side of said traveler car, while leaving the cleat means on the other side of the traveler car undisturbed.

More particularly, it is an objective of the invention to provide a traveler having the foregoing advantages in which a movable plate is provided on the traveler car, being movable to and fro relative to the traveler car, and in which the cleat means are mounted on either side of said plate means, and in which the finger means are mounted on the traveler car in fixed relation thereto, movement of the plate means moving the cleat means relative to the finger means thereby releasing the cleat means.

More particularly, it is an objective of the invention to provide a traveler having the foregoing advantages in which the cleat means are mounted on a movable plate, the plate being movably connected to the upper side of the traveler car, and in which the finger means extend from a fixed plate, being fastened in fixed relation to the traveler means above the movable plate, the traveler car and fixed plate being movable relative to the movable plate, in unison with one another, to procure releasing of the cleat means.

Preferably the control ropes will run around pulleys mounted on either side of the traveler car. The pulleys are mounted in fixed relation to the cleat means, preferably on the movable plate.

In an alternate embodiment the traveler car carries a fixed mounting plate and the cleat means, and pulleys, are mounted on it. The traveler car has a movable mounting, eg. a slot, for mounting the main sheet block so that it can move relative to the fixed plate. Cleat releasing fingers are movably carried on the plate, and are connected to the main sheet block.

In both embodiments, wind pressure on the sail causes relative movement as between the traveler car (or main sheet block on the traveler car) and the cleat means, and thus causes operation of the cleat releasing fingers.

The invention also provides a cam cleat having a cam cleat releaser for opening of the cam cleats.

The various features of novelty which characterize the invention are pointed out with particularity in the claims annexed to and forming a part of this disclosure. For a better understanding of the invention, its operating advantages and specific objects attained by its use, reference should be had to the accompanying drawings and descriptive matter in which there are illustrated and described preferred embodiments of the invention.

IN THE DRAWINGS

FIG. 3 is a section along the line 3—3 of FIG. 2;

FIG. 4 is a an exploded view of the traveler of FIG. 2;

DESCRIPTION OF A SPECIFIC EMBODIMENT

Figure 1:
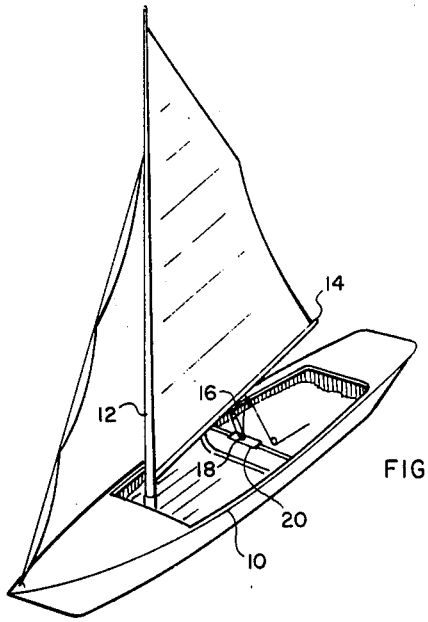
FIG. 1 is a perspective illustration showing a typical sailboat incorporating a traveler according to the invention.

Turning now to FIG. 1, a typical sailboat is illustrated, being of the two-man center-board dinghy type, and having a hull 10, mast 12 and boom 14, on which the main sail is rigged, and having all of the other usual accessories of such a sailboat, the details of which are omitted for the sake of clarity.

In order to control movement of the boom, and to permit it to be swung out or drawn in, a main sail rope or sheet 15 is provided, running around one or more blocks 16 attached to the boom, and a further block 18 located on the traveler 20. The main sail sheet 15 is simply a length of rope, and the blocks 16 and 18 may be of the multiple sheave type so as to permit the main sheet 15 to be arranged in several "parts" depending upon the sail area of the main sail and other factors. The block 18 may incorporate a cam cleat (not shown) or any other suitable cleating means may be provided on the hull 10 for example depending upon the design of the sailboat, and the choice of the crew. All of these features are essentially well known in the art and require no further description.

Figure 2:
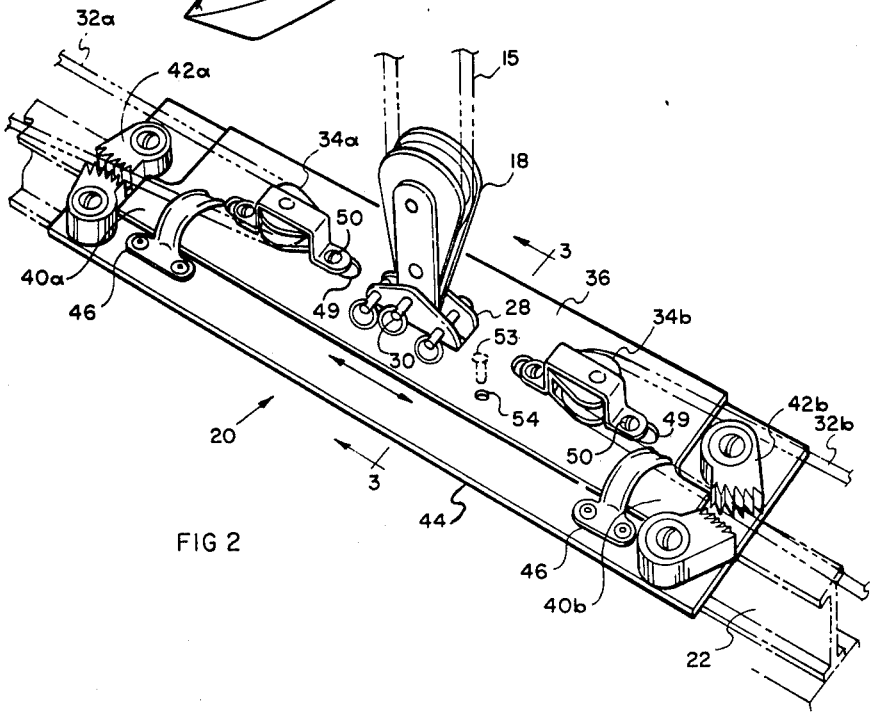
FIG. 2 is a greatly enlarged perspective illustration of the traveler, showing a portion of the track way cut away for the sake of clarity.
Figure 5:
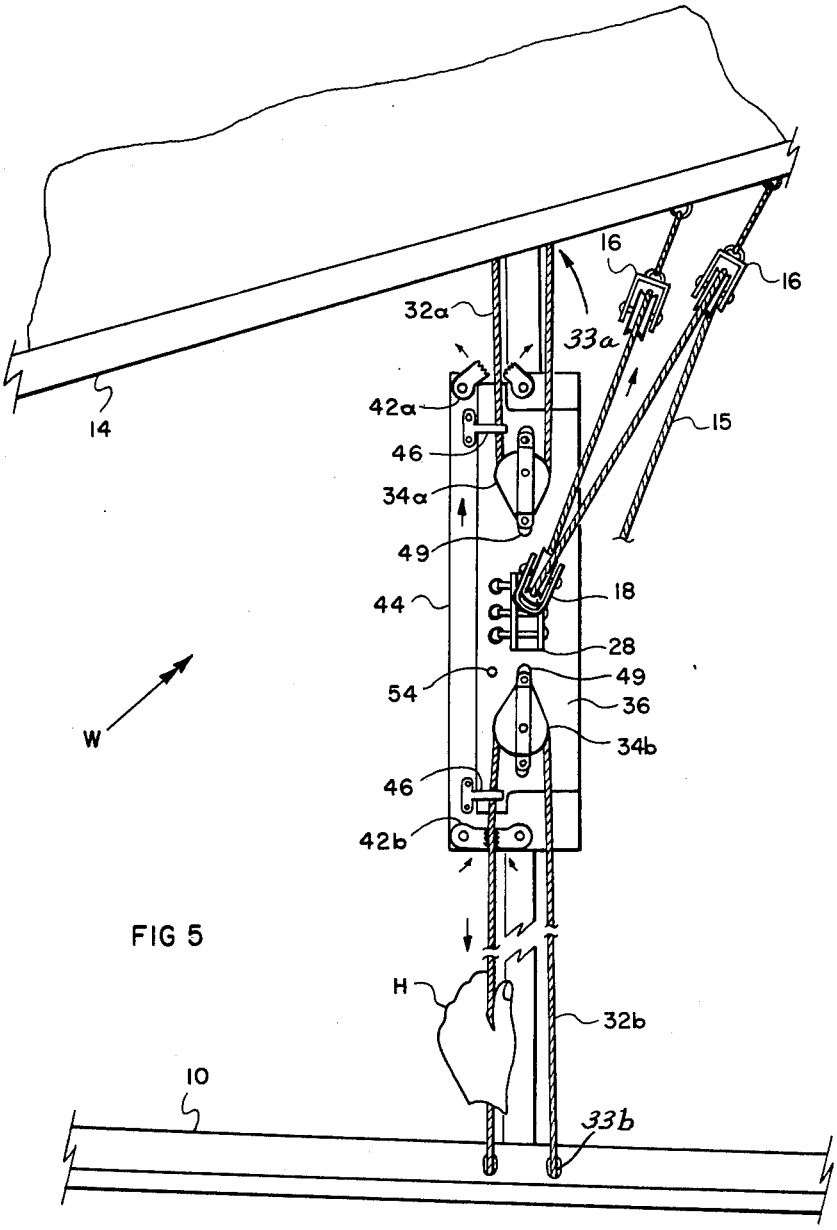
FIG. 5 is a top plan view of the traveler in use with the main boom on the starboard side of the boat, and the crew on the port side of the boat.

The traveler 20 is shown in greater detail in FIGS. 2 and 5. In accordance with the invention, the traveler 20 will be seen to comprise a transverse track way 22, usually formed of metal, and having a variety of different shapes. The track 22 is usually attached to suitable points on the hull at spaced intervals therealong, and may be supported by a transverse wooden thwart, to which it may be attached by screws, bolts or the like for extra strength. A traveler car 24 is provided, to run to and fro along the track 22. The traveler car 24 may be of a variety of different designs, but will usually be provided with some form of antifriction means such as rollers 26 fitting around a portion of the track 22, so as to permit the traveler car 24 to run along the track 22 even when a substantial load is applied to the main sheet block 18. A variety of different designs and shapes of rollers 26 are in use in the art and form no part of the invention.

Any suitable attachment or mounting means such as the mounting flanges 28 are provided on the upper side of the traveler car 24 for attachment of the main sheet block 18, usually by means such as a locking pin or bolt 30. In order to control the position of the traveler car, and to pull it to and fro along the track 22, a pair of control ropes 32*a* and 32*b* are provided, being the starboard and port control ropes. These control ropes are attached at one of their ends 33*a* and 33*b* to for example, any suitable portion of the hull, or to the ends of the track way 22 or any other suitable position. Control ropes 32*a* and 32*b* run around control pulleys 34*a* and 34*b* on the traveler car 24 and the free ends may be left loose, or preferably will be led around further pulleys (not shown) within the hull and attached to for example elastic or so-called "shock" cords (not shown) concealed within the hull. In this way possible entanglement of such free ends is prevented. Such arrangements are well known in the art and require no illustration. Depending upon the size and design of the sailboat, such control ropes may be arranged in multiple parts, so as to provide a greater mechanical advantage or purchase for the helmsman or crew for pulling the traveler to and fro, but in the majority of cases a simple two-part purchase is all that is required, substantially as shown. A plate 36 is mounted on traveler car 24 and has a slotted opening 38 which is dimensioned so as to make a snug fit around the flanges 28, and to permit the flanges 28 to extend thereabove for insertion of the pin 30 for fastening of the main sheet block 18 thereto. However, the provision of the slotted opening 38 is merely a simple and convenient method of attaching the plate 36 to the traveler car 24, and any other means of attachment would be equally suitable. A pair of cleat releasing fingers 40*a* and 40*b* are provided at each end of the plate 36 for purposes to be described. The provision of the cleat releasing fingers on the plate 36 is merely one convenient way of providing such cleat releasing fingers. They could equally well be attached to the traveler car 24 in any other way, or be formed integrally therewith if desired.

In order to cleat the control ropes 32*a* and 32*b* a pair of cam cleats 42*a* and 42*b* are provided, mounted on a movable slide plate 44. The cam cleats 42*a* and 42*b* are of any well known design such as has been in use in the art in many years. Each cam cleat 42*a* or 42*b* is comprised of a pair of swingable cam members mounted on spaced apart pivot pins, and having inwardly facing teeth for engaging the rope. Usually springs will be provided for closing the cam cleats on the rope. The rope can be drawn through the cam cleats in one direction, but as soon as it is released the pull of the rope will be held by the pinching action of the cam cleats as they swing inwardly towards one another. The various characteristics and details of such cam cleats have not been illustrated since they are well known in the art.

Preferably, although not essentially, any suitable rope guides such as the U-shaped members 46 will be provided, mounted on the slide plate 44, so as to guide the ropes 32*a* and 32*b* through their respective cam cleats 42*a* and 42*b*. The plate 44 is slidably mounted on the traveler car 24 being located between the traveler car 24 and the fixed plate 36. The plate 44 is slidable to and fro relative to the traveler car 24 and relative to the plate 36. In order to permit such sliding movement an overside slotted opening 48 is provided in the plate 44. The slot 48 has a width dimension such that it makes a snug fit around the flanges 28, but has a length dimension such that it may slide to and fro transversely relative to the flanges.

Plate 36 has two further slotted openings 49 on either side of opening 38. Pulleys 34*a* and 34*b* are fastened to slide plate 44 by bolts 50 passing through openings 49 and secured in holes 52 in plate 44. In this way pulleys 34*a* and 34*b* are mounted in fixed relation to cam cleats 42*a* and 42*b*, and both the pulleys and cam cleats are capable of movement relative to the traveler car 24.

The operation of the invention is best explained with regard to FIGS. 3 and 5.

Assuming the wind indicated by the arrow W is coming from the port side of the boat, and the helmsman, indicated by the hand H, is sitting on the port side of the boat, and the boom 14 is swung out slightly to starboard, then the boom 14 is applying tension to the main sheet 15 tending to pull the block 18 and traveler car 24 is starboard.

The helmsman wishes to adjust the position of the block 18 and traveler car 24, and thus grasps the portion of the control rope 32b, which is passing through the cleat 42b. He may then pull the rope towards him, through the cleat 42b thus drawing the entire traveler car 24 towards him. Alternatively he may release the ropes 32b from cleat 42b, by raising the rope upwardly, and then release rope 32b gradually, thereby permitting the car 24 to move away from him.

Assuming the rope 32a is clear of the cleat 42a, on the starboard side of the boat then the traveler car 24 will be free to move in response to pulling or releasing of the rope 32b as described.

However, in the great majority of cases, especially where the sailboat is being tacked from one tack to the other fairly frequently, the rope on the leeward side of the boat, e.g., the control rope 32a will in fact be cleated in the cleat 42a. This will mean that, before the traveler 24 can move to port, in response to a pull by the helmsman on the rope 32b, the rope 32a must be released from the cleat 42a.

In accordance with the invention, this is achieved by reason of the fact that as soon as the boom 14 applies tension to the sheet 15, and block 18 it will tend to draw the traveler 24 to starboard. Such tension will thus move the plate 36 relative to the slide plate 44, to starboard. This will bring the starboard finger 40a into contact with the starboard cleat 42a thereby opening the cleat as shown in FIG. 5 and releasing the rope 32a.

The helmsman sitting on the port side can thus adjust rope 32b either by pulling it or releasing it to move the traveler 24 to and fro, without having to worry about the cleat 42a or rope 32a at all.

As soon as he tacks the boat on to starboard tack, the opposite situation prevails. The boom 14, through the sheet 15 and block 18 now applies pressure to the traveler 24 tending to draw it to port. Plate 36 is free to slide in response to such pressure and will move, bringing the port side finger 40b into contact with the port side cleat 24b thereby opening the cleat 42b and releasing the rope 32b.

The helmsman can then pull rope 32a through cleat 42a to adjust and secure the traveler once more.

It will of course be appreciated that the invention may be achieved in a variety of different ways. For example, the entire plate 36 could be dispensed with, and it could simply be formed as an extension of the traveler 24 either above or beneath the slide plate 44. If it was located beneath the slide plate 44, it could simply be in the form of two shafts or rods lying beneath the plate 44, with upstanding pins or fingers fitting through suitable slots in the plate 44 to operate the respective cam cleats. Alternatively, the clam cleats could be made with downward extensions extending below the plate 44 which could then be operated simply by push rods extending sideways from the traveler 24.

Similarly, the block 18, for example by means of the flanges 28, could be made slidable relative to the traveler 24 so that it slid from side to side, and operated fingers similar to the fingers 40a and 40b or other means, for contacting one or other of the cam cleats.

It will of course be appreciated that the invention is in either case making use of the fact of the pull of the main sheet block 18 to leeward, and that by permitting relative movement between the block 18, or its point of attachment ie. the traveler car itself, and the leeward cam cleat, whether by moving the cam cleat relative to the block, or by moving the block relative to the cam cleat, a means of opening the leeward cam cleat is provided.

If it desired to lock the traveler so that it will not be self-releasing, then any suitable locking means can be provided such as holes 54 and 55 in plates 36 and 44, for receiving locking pin 53 (shown in phantom).

Figure 6:
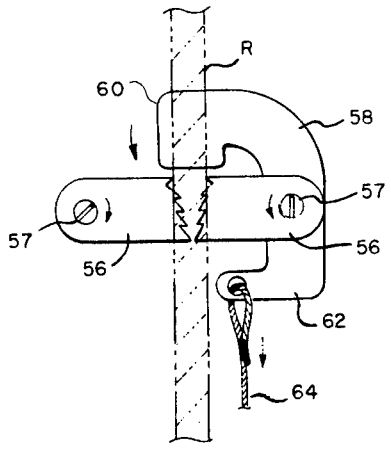
FIG. 6 shows an alternate embodiment.

The invention may also be applied to a single cam cleat as shown in FIG. 6. Here a typical cam cleat 56 is shown mounted on screws 57, for securing a rope R shown in phantom.

A cleat releaser comprises a crank 58 having a pusher 60 at one end and an arm 62 at the other. Crank 58 is pivotted on, eg., a screw 57 which is itself the pivot axis of one of the cams 56, and is spring urged into the open position. The cord 64 on arm 62 permits the crank to be swung to open the cleat.

Such a cleat releaser is thus normally disengaged, permitting free operation of the cam cleat in the normal way, but may be operated by remote means as desired.

Figure 7:
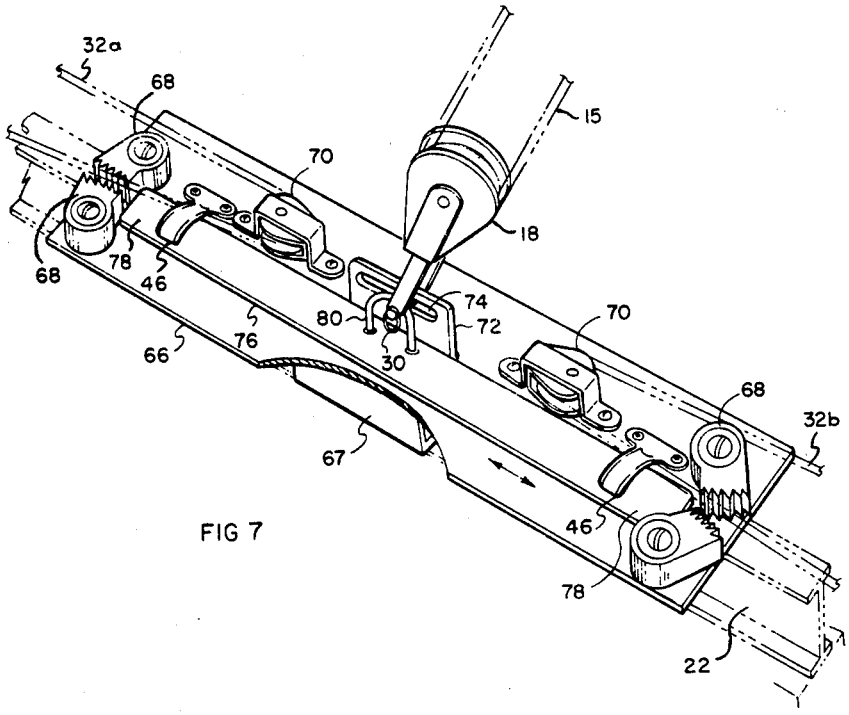
FIG. 7 is a perspective of a further embodiment.

It is also conceivable that the slide plate 44 can be dispensed with. Instead the fixed plate 36a will be enlarged in the form of plate 66 (FIG. 7), and fastened to car 67. Cleats 68 and blocks 70 will be mounted in fixed relation on plate 66.

Flanges 72 will be provided with an elongated slot 74 and main sheet block 18 will be attached by pin 30 sliding in the slot 74. An elongated pusher bar 76 is slidable on plate 66 and has fingers 78 for opening cleats 68. An upstanding yoke 80 engages pin 30 and is operated by movement of the block 18 relative to the flange 72.

Wind pressure on the sail (not shown) will draw block 18 to leeward to one end of slot 74. Movement of block 18 will force bar 76 to move in the same direction, i.e., to leeward, across the surface of plate 66. Finger 78 at the leeward end of the bar 76 will then engage and open the cam cleat 68 at the leeward end of the plate 66.

The helmsman can then adjust the position of plate 66, and car 67, by, i.e., pulling on or releasing the control rope 32 on the weather end of plate 66.

When the boat tacks the wind pressure is then applied to the opposite side of the sail. This causes movement of block 18 along slot 74, thereby moving bar 76 and finger 68 at the opposite end thereof into engagement with the other cleat 68.

While the invention is illustrated in connection with typical cam cleats having two spring-operated cams swingable towards and away from each other, it is not confined exclusively to such cleats. Other cam cleats are known having a single cam, and a fixed abutment, and the invention is equally applicable thereto.

The foregoing is a description of a preferred embodiment of the invention which is given here by way of example only. The invention is not to be taken as limited to any of the specific features as described, but comprehends all such variations thereof as come within the scope of the appended claims.

What is claimed is:

1. A traveler for use in sailboats and the like, adapted to move to and fro along a fixed track way located in the sailboat, and being controlled from opposite sides by two respective control ropes by means of which it may be positioned at various different positions along the track way, said traveler comprising:

traveler car means for moving to and fro along said track way and adapted for carrying a block thereon for tensioning of a third rope therethrough in two opposite directions across a said sailboat;

cleat means mounted on opposite sides of said traveler car means, said cleat means being adapted to releasably engage respective said control ropes, said cleat means and said block being movable relative to one another along the direction of said track way, and, cleat releasing means mounted on said traveler car means, and connected to be responsive to relative movement between said cleat means and said block to move between respective cleat engaging and disengaging positions.

2. A traveler as claimed in claim 1 wherein said cleat means is fixedly attached relative to said traveler car means, and said cleat releasing means is movable relative to said traveler car means and said cleat means.

3. A traveler as claimed in claim 1 including block attachment means on said traveler car means defining an elongated slotted opening, adapted for attachment of a block for said third rope thereto, whereby said block may slide to and fro along said opening relative to said traveler car means.

4. A traveler as claimed in claim 3 including connection means for connecting between said third rope block and said cleat releasing means whereby movement of said third rope block along said opening causes movement of said cleat releasing means.

5. A traveler as claimed in claim 1 including mounting plate means mounted on said traveler car means and having two ends, said cleat means being located on opposite said ends of said plate means.

6. A traveler as claimed in claim 5 including rope guide members mounted on said plate means in registration with said cleat means.

7. A traveler as claimed in claim 1 including flange means on said traveler car means extending upwardly therefrom and mounting plate means on top of said traveler car means with said flange means extending thereabove.

8. A traveler as claimed in claim 1 including plate means on said traveler car means extending on opposite sides thereof, and control pulley means fastened on said plate means for reception of respective control ropes therearound.

9. A traveler as claimed in claim 1 wherein said cleat means comprise two cam cleat members, one said cam cleat member located on one side of said traveler car means, and the other said cam cleat member on the other side of said traveler car means.

10. A traveler as claimed in claim 1 wherein said cleat releasing means is fixedly located relative to said traveler car means, and wherein said cleat means is movably located relative thereto, thereby permitting relative movement between said cleat means and said traveler car.

11. A traveler as claimed in claim 10 including cleat mounting plate means attached to said traveler car means and extending outwardly on either side thereof, and cleat means mounted on either end of said cleat mounting plate means, and an elongated slotted opening formed in said cleat mounting plate means, and upwardly extending flange means on said traveler car means extending upwardly through said slotted opening, said slotted opening being formed with a length dimension greater than the length of said flange means whereby to permit a sliding movement of said cleat mounting plate means relative to said traveler car means.

12. A traveler as claimed in claim 11 including fixed plate means located above said cleat mounting plate means and attached to said traveler car means, said fixed plate means being formed with finger means at either end thereof for engaging said cleat means for releasing the same as aforesaid, and including control rope pulleys on said cleat mounting plate means.

13. A traveler as claimed in claim 12 including slotted openings in said fixed plate means and fastening means fastening said pulleys to said cleat mounting plate means, said fastening means extending through said slotted openings whereby said cleat mounting plate means, and said cleat means and said pulleys may move in unison relative to said fixed plate means.

14. A remotely operable cam cleat of the type used for securing ropes on a sailboat, and the like, said cam cleat having at least one locking cam member movable in a predetermined plane, into and out of engagement with a rope whereby to jam the rope and secure it, said cam cleat including cam releasing means movable independently of said at least one locking cam member, along a predetermined path in a plane parallel to the plane of movement of said locking cam member into and out of engagement with said at least one locking cam member, and means for operating said cam releasing means, whereby said locking cam member may be disengaged from said rope.

15. A remotely operable cam cleat as claimed in claim 14 wherein said cam cleat includes two locking cam members swingable towards and away from one another whereby to engage and disengage a rope therebetween, and wherein said cam releasing means is movable in said parallel plane relative to both said locking cam members, said locking cam members being movable independently of said cam releasing means between rope clamping and releasing positions, movement of said cam releasing means in said parallel plane causing the same to engage both said locking cam members, and cause the same to swing away from one another for releasing said rope.

16. A remotely operable cam cleat as claimed in claim 14 including attachment means on said releasing means for attachment of remote operating means such as rope thereto, whereby said releasing means may be operated from a remote location.

17. A remotely operable cam cleat as claimed in claim 14 including pivot members for respective said locking cam members and wherein said cam releasing means comprises a crank member swingably mounted on a said pivot member, and having a cleat releasing finger at one end, said finger being swingable into and out of engagement with said cam locking members, and including operating means on the other end of said crank member whereby the same may be swung to and fro.

18. A releasable cam cleat of the type used for securing ropes on a sailboat, and the like, said cam cleat having at least one clamping cam movable between a rope releasing and a rope clamping position, and a cam releasing member mounted for movement between cam engaging and disengaging positions, said cam being movable independently of said cam releasing member when the same is disengaged from said cam, movement of said cam releasing member into engagement with said cam, moving said cam into its rope releasing position as aforesaid.

19. A releasable cam cleat as claimed in claim 18 including two said cams movable between rope releasing and rope clamping positions, said cam releasing member being normally disengaged from both said cams and being engageable with both said cams for movement thereof into their rope releasing position.

* * * * *